United States Patent [19]

Takahashi

[11] Patent Number: 4,740,352

[45] Date of Patent: Apr. 26, 1988

[54] METHOD FOR THE FREEZE-PRESSURE MOLDING OF METALLIC POWDERS

[75] Inventor: Nobuyuki Takahashi, Saitama, Japan

[73] Assignee: Mitsubishi Corporation, Tokyo, Japan

[21] Appl. No.: 722,182

[22] Filed: Apr. 10, 1985

[30] Foreign Application Priority Data

Apr. 12, 1984 [JP] Japan ..... 59-73642

[51] Int. Cl.[4] ..... B22F 1/00

[52] U.S. Cl. ..... 419/23; 419/36; 419/37; 419/38; 419/41; 419/43; 419/53; 419/54

[58] Field of Search ..... 419/36, 37, 38, 41, 419/23, 43, 53, 54

[56] References Cited

U.S. PATENT DOCUMENTS

| | | | |
|---|---|---|---|
| 2,893,102 | 7/1959 | Maxwell et al. | 419/40 |
| 3,976,435 | 8/1976 | Klein | 419/2 |
| 4,002,473 | 1/1977 | Klein | 419/40 |

*Primary Examiner*—Stephen J. Lechert, Jr.
*Attorney, Agent, or Firm*—Michael J. Striker

[57] ABSTRACT

The present invention is concerned with a method of molding metallic powders, in which a binder fluid having a specific freezing point, typically water, is added to the metallic powder to be molded to form a mixture, after which a die having the desired cavity is filled with said mixture. The mixture is then pressure molded and rapidly cooled, freezing the binder fluid to produce a frozen molded shape, which is then dried to remove the binder fluid and sintered.

The amount of the binder fluid of specific freezing point to be added to the said metallic powder is the minimum amount that will satisfy the dual demands of flowability during molding and shape retention after the removal of the binder fluid, with from 25 to 50 vol% generally being appropriate. Molding is achieved by injection molding, compression molding or other technique in which pressure is applied to the material in the mold.

The present invention makes possible the easy and economical mass production of sintered products of complex shape, high dimensional accuracy, and high density using metallic material.

26 Claims, 3 Drawing Sheets

METHOD FOR THE FREEZE-PRESSURE MOLDING OF METALLIC POWDERS

BACKGROUND OF THE INVENTION

The present invention is concerned with molding, specifically by a technique employing freezing and pressure, of metallic powders.

Products molded from metallic powders are coming into more and more common use, thanks to the many advantages they offer over items machined from fused bodies, and compression molding using a molding die is being adopted as a means of mass producing them. The problem is, however, that only relatively simple shapes can be produced by this method. To make objects of complex configuration, and particularly those that are stepped in the direction in which pressure is applied such as boxes, the density of the compressed powder body varies from place to place so that it is impossible to obtain satisfactory products.

To overcome this, an injection molding method has been proposed. However because of the poor flowability of the powder feedstock itself, it is difficult to fill the mold cavity for complex shapes uniformly to the very corners, and because of friction between the powder and the die walls, it is not possible in practice to apply sufficient molding force.

To counteract this, a method has been used in which powdered resin is added to the powder feedstock as a binder, heat is applied to melt the resin, and the resulting flowability utilized in effect molding.

However the application of this method involves the use of considerable amounts of resin binder, so that the product is actually plastic, with a high metallic content.

This led to the following problems:

1. Because of the admixture of a large amount of resin binder, the sintered body tends to be porous. This, coupled with a large amount of shrinkage makes it difficult to guarantee the high dimensional accuracy and high density suitable for machine components.

2. If dewaxing (the removal of the resin binder by heating and decomposing into gas prior to sintering) is carried out too precipitously, scaling and deformation occur. To avoid this, the rate of temperature rise must be reduced and high temperatures cannot be used. As a result, the process of removing the binder requires an inordinate amount of time. As a result, productivity is reduced, and vast amounts of heat are required, leading to higher production costs.

3. When a resin binder is used, it is mixed with the metallic powder, heated, and injected into the mold. Since, however, the viscous resistance of the binder is greater, the behavior of the binder when flowing gives rise to uneven distribution of the powder in the molded object, which tends to manifest itself after sintering as product defects. In places where the resin binder flows readily, the powder density is lessened, while it becomes correspondingly greater in the corners. Furthermore, the resin may be concentrated along the weld line (the flow front of the mixture) so that a resin binder layer is present on the surface leading to increased surface roughness after sintering.

4. If the amount of resin binder is reduced, molding parameters such as the pressure and temperature of injection become more critical and harder to control.

BRIEF DESCRIPTION OF THE INVENTION

The present invention is an attempt at overcoming the problems enumerated above.

Its primary object is to make possible the easy and efficient mass production of products from dust-type metallic powders, having complex shapes, high dimensional accuracy, and high density.

Another object of the present invention is to eliminate the time-consuming process of dewaxing involved in the conventional method of injection molding of metallic powders, and to effect a major improvement in the simplicity and productivity of the process.

Another object of the present invention is to produce products from dust-type metallic powders, having outstanding characteristics as mechanical components, which have uniform distribution of powder density throughout the molded object, are free of the problems associated with the use of resin binders—including weld lines, reduced strength due to binder residues, and the surface binder layer—and have extremely good surface roughness.

Another object of the present invention is to enable runners, burrs and other scrap to be recycled directly into feedstock for improved yield.

Another object of the present invention is to offer a high degree of freedom in the choice of molding method, allowing products of complex configurations containing slits to be molded easily, even by means of the simple compression molding process, and when applied to injection molding, to dispense with screws and thus eliminate worries over screw wear and remove the need for screw assembly temperature control and control of heating times.

Another object of the present invention is to significantly reduce binder cost and eliminate environmental or pollution problems.

In order to achieve the abovementioned objects, the present inventor has conducted repeated experiments, and has provided an alternative to the conventional concept, which holds that the setting of an object molded from metallic powder in the dust state requires that the particles of powder be brought into mechanical bonding by means of an adhesive substance. By taking advantage of the properties of fluids such as water, that have a specific and easily attainable freezing point—namely that they flow readily at normal temperature, can be made to freeze at reduced temperature, and will sublimate—the present invention makes possible the molding of the target configuration either wholly without resin-based binders, or with a greatly reduced resin binder content.

That is to say, the distinctive features of the present invention lie in molding metallic powders; in adding a binder fluid with a specific freezing point (typically water) to the metallic powder to be molded to form a mixture; in then filling a die having the desired cavities with the said mixture and rapidly cooling the molded mixture so that the binder fluid contained freezes; in then drying the frozen molded shape so that the frozen binder sublimates; followed by sintering.

The main problems in metallic powder molding are flowability and the strength of the molded shape. If flowability is inadequate, the powder will not penetrate to the very edges of dies having complex configurations. Since molded objects having complex configurations are normally released from the die using knockout pins, they will be deformed unless their strength (shape retention) properties are adequate. Thus it has traditionally been considered essential to use heat to fuse and set the binder.

In contrast, the present invention proposes that a fluid with a specific freezing point be used as the binder. If, for example, the binder fluid is water or aniline, it forms an extremely thin coating around the particles of powder. Because of the low viscous resistance of this coating, even a small amount of water or aniline reduces the values of particle-to-particle and particle-die surface friction resistance, thereby greatly increasing the flowability of the powder. On the other hand, the low viscosity of water and aniline means that bonding power is degraded, so that the shape retention characteristics of the molded object will be inadequate. However water and aniline freeze when cooled and the crystals thus formed bond the particles of powder, with the result that the molded object hardens in the same configuration in which it was molded, with sufficient shape retention strength for die release.

Furthermore, since water and aniline sublimate, the binder can be removed easily and in a short time. And since the molded object has been subjected to pressure in the die, it does not crumble, but retains its as-molded shape well, even when the binder is removed. Also, in addition to being pressure molded, binder viscosity is low, with the result that the density of the molded object is high and material distribution is uniform. What is more, the surface of the molded object is extremely smooth.

DETAILED DESCRIPTION OF THE INVENTION

The following is a specific description of the present invention based on the accompanying figures.

Figure 1:
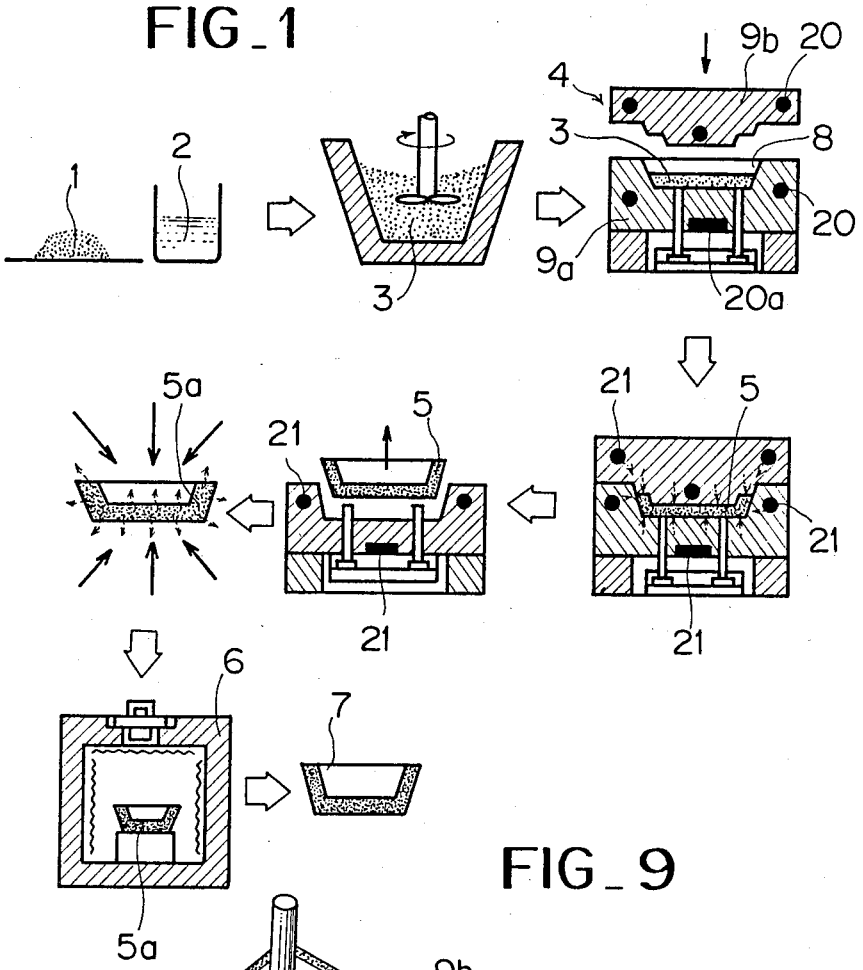
FIG. 1 is an explanatory view showing the fundamental process for the freeze-pressure molding method that is the subject of the present invention, FIG. *2a* and FIG. *2b* are cross sectional views showing the molding conditions when the compression molding method is used.
Figure 9:
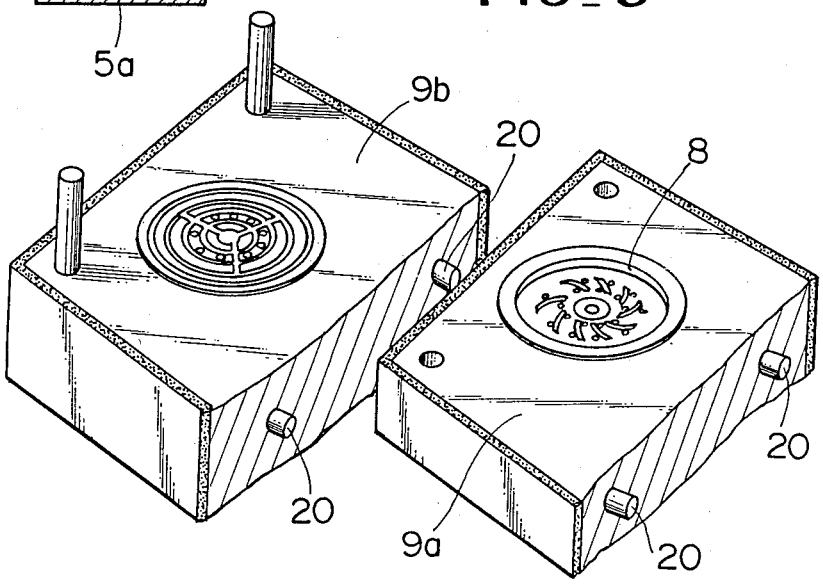
FIG. 9 is a perspective view showing the the die for the prototype shown in FIG. 7 and FIG. 8.

FIG. 1 shows the freeze-pressure molding method for metallic powder that is the subject of the present invention in process order, namely:

I. A process in which, to a metallic powder feedstock (1), is added a binder fluid having a specific freezing point (2), to form a mixture (3) capable of providing the required flowability and shape retention after molding.

II. A process in which the mixture (3) is introduced into a molding means (4) and subjected to pressure molding it into the desired shape, which is then rapidly cooled to freeze the binder fluid (2) forming a frozen molded object (*5a*).

III. A process in which the frozen molded object (*5a*) is dried, inserted into a furnace (6), and sintered, forming a sintered object (7).

Specifically, the process in which the mixture (3) is obtained is carried out by placing the powder feedstock (1) from which the object is to be molded in a mixer, adding the binder fluid (2), and mixing until uniform. Mixing should be carried out at room temperature. The feedstock powder contains staple fibers.

Typical of the powder feedstocks used with this invention are metallic powders of two or more constituents (including alloy particles and compound particles) or materials of which the primary constituent is metallic particles, with which nonmetallic particles, e.g., ceramics, have been mixed.

In general, the powder feedstock (1) should have the smallest possible particle diameter—fines or superfines—although this depends on the molding method. This has the advantage of resulting in the formation of floc having many points of mutual contact, so that sinterability is excellent, and in addition excellent flowability can be obtained by adding only a little of the binder fluid of specific freezing point (2). Depending on the binder fluid used, we may say that the optimum average particle diameter of the powder feedstock would be 1 μm or less. It is of course also possible to obtain satisfactory flowability for powders with average particle diameters of 3–10 μm in accordance with the present invention.

A fluid of specific freezing point (2) is the binder used in the present invention, and it should freeze at a temperature in the vicinity of 0° C. It is desirable that is also be chemically inactive in respect of the powder feedstock (1) or at least not produce deterioration in feedstock quality, and further of sublimating readily when frozen so that no residue is left in the product after sintering.

This binder fluid (2) is selected in accordance with the properties of the powder feedstock (1). The cheapest and most convenient is a metallic powder, water (including industrial, distilled and deionized). Even if the powder feedstock is oxidized by the addition of water, there is virtually no problem because the reducing atmosphere employed in the sintering process reduces it again. In addition inorganic or organic fluids, or mixtures or compounds of one or more such fluids may also be used, as well as mixtures or compounds of such fluids with water.

Examples of organic fluids of specific freezing point include aromatic compounds typified by aniline, benzene and nitrobenzene; alcohols such as glycerine, tert-butanol, 1,4-dioxane, cyclohexanol and cyclohexane; ethers, oxides and mercaptan; as well as acetic and other organic acids, dimethyl carbonate and other carbonate esters, 1,2-dichlorethane and other halogenated aliphatic hydrocarbons.

Examples of inorganic fluids of specific freezing point include hydrogen peroxide; metallic acids including sulphuric, hydrochloric and nitric; and ammonia water and other alkalis.

The amount of binder fluid (2) added to the powder feedstock (1) is determined by the need to satisfy three conditions: firstly, that it will impart to the mixture (3) sufficient viscosity that it will penetrate to the farthest corners of the die; secondly, that during rapid cooling, crystals of frozen material will form at least as a shell on the exterior of the molded object adequately binding between the particles; and thirdly, that even when the frozen binder (2) has sublimated, the object will not crumble, but will be able adequately to retain the as-molded shape. Within these limits, the smallest amount possible is best.

In general, the more binder fluid added, the more the flowability of the mixture increases. On the other hand, shape retention during binder sublimation suffers, making it impossible to avoid a drop in the density of the product. Sintering, too, will require an inordinately long time. Conversely, when the amount of binder fluid added is too small, shape retention is good but the flowability of the mixture during molding decreases, and shape and dimensional accuracy deteriorate.

Specific determination of the amount added depends on such factors as the diameter of powder particles, the molding method and molding conditions, and the configuration and dimensions of the molded object.

The present inventor has investigated the relationship between the amount of the binder fluid (2) and flowability. The powder feedstocks used were tungsten micropowder with an average particle diameter of 0.78 μm, molybdenum powder with an average particle diameter of 1 μm, and carbonyl 1 iron powder with an average particle diameter of 0.3 μm. The binder fluid was water. In measuring flowability, the swirl-type viscosity test used in investigating flowability in the plastics field was employed, and length of flow was measured. Conditions were room temperature (25° C.), a plunger pressure of 210 kgf/cm$^2$, and nozzle diameter of 3.2 mm.

The result was that for all of the powders, the flow length was virtually zero at additive amounts of 20 vol % or less. At 30 vol % a flow length of approximately 4 cm was obtained, and this increased to 20 cm at 50 vol %. At 58 vol % the flow length increased precipitously.

The admixture of water resulted in the formation of an extremely thin water coating on the surface of the particles. This acted as a binder producing viscosity, and when molding pressure was applied acted as a lubricant producing flowability. In mixing in a mortar, additions of from 25 to 50 vol % yielded a viscous and somewhat dry powder which could be packed into balls by hand. Mixtures of 55% were somewhat creamy, and higher percentages resulted in slurries.

Next, shape retention was investigated. In this experiment, mixtures with binder fluid contents of 25, 35, 45, 50, and 55 vol % were frozen by injection into liquid nitrogen at −7° C. These were then naturally dried and their condition was observed. Mixtures with binder fluid contents of 25, 35, 45 and 50 vol % retained the as-injected shape, but at 55 vol %, the shape crumbled.

In addition, the present inventor investigated the relationship between the amount of water added and the flowability and shape retention characteristics, using the abovementioned feedstock powders having average particle diameters of approximately 1.2, 1.5, 2, 3, 8, 10, 12, 15 and 20 μm. The results showed that at average particle diameters 0 μm or more, even with the addition of water in excess of 55 vol % flowability was not achieved during injection. This trend holds true even when the binder fluid used was aniline or glycerine.

From these results, we may generally say that to obtain the high-precision, high-density molded objects that are the aim of the present invention, the average diameter of the particles of the powder feedstock should be 1 μm or less. If, however, the molding method used is one that, like compression molding, does not use a fine nozzle, this limitation is not operative, but if it is desired, as is the intention of the present invention, to obtain high-density products with a smooth surface, it is generally desirable that the average particle diameter should be 1 μm or less. In addition, under these conditions the amount of binder fluid to be added should be approximately 25–50 vol %. Increasing the binder fluid content by approximately 1–3 vol % makes possible extrusion from the die by pressure during molding, but any further increase results, in addition to the difficulties previously referred to, in the problem of the powder being sluiced away through the die interstices.

The basis of the present invention is that only a fluid of specific freezing point is used as the binder, but it is also permissible to add a minute quantity of ordinary organic binder—say 1–2 vol %—to prevent breakage during drying and sintering.

Next is the molding of the mixture (3). In accordance with the present invention, simple casting techniques—like slip casting or casting under reduced pressure or with the addition of agitation—are unsuitable. A method that actively applies a compressive pressure to the mixture (3) must be used.

The reasons for this are, in addition to the need to to raise the density of the molded object, to spread the mixture rapidly to the farthest corners of the cavity so that flowability is not impeded by freezing, and to apply pressure in the thickness direction of the molded object, in order to squeeze the fluid to the outer layer of the molded object, and to rapidly form a frozen layer with sufficient strength for mold release.

Figure 2A:
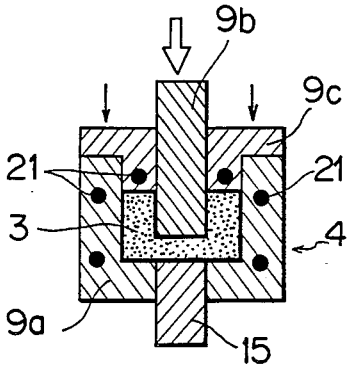
Figure 2B:
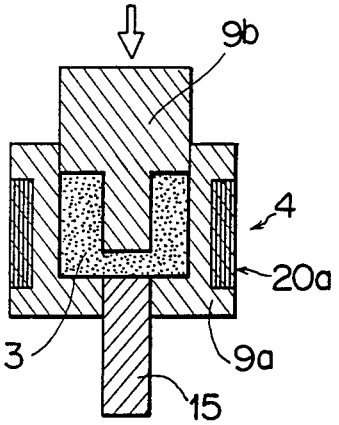
Figure 3:
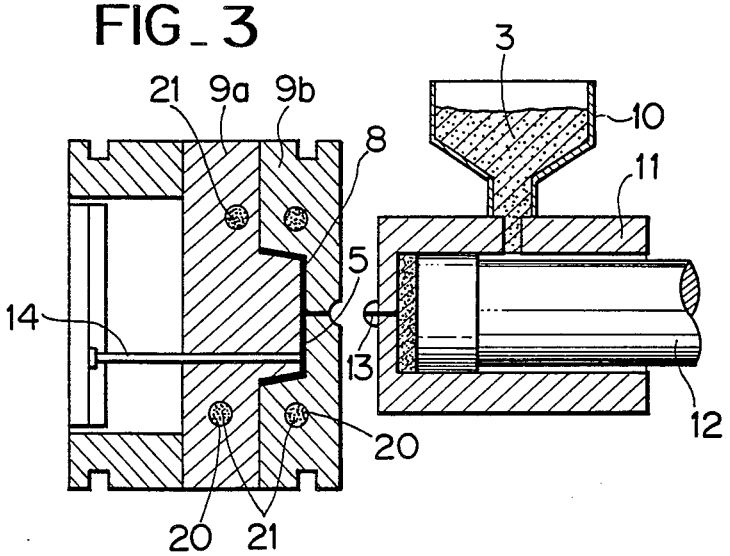
FIG. 3 is a cross sectional view showing the molding conditions when the injection molding method is used, FIG. *4a*, FIG. *4b*, FIG. *5a* and FIG. *5b* are cross sectional views showing the molding conditions when the ring molding method is used, FIG. *6a* and FIG. *6b* are typical magnified representations of the molded state in the present invention.
Figure 4A:
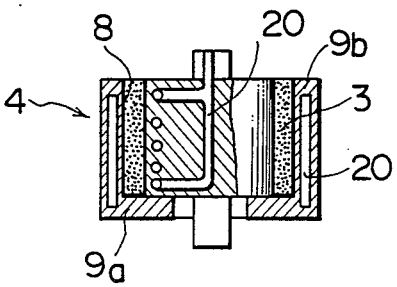
Figure 4B:
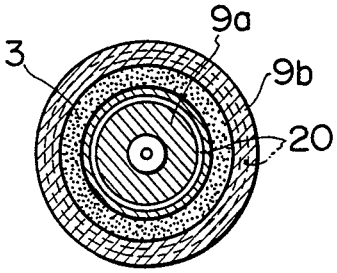
Figure 5A:
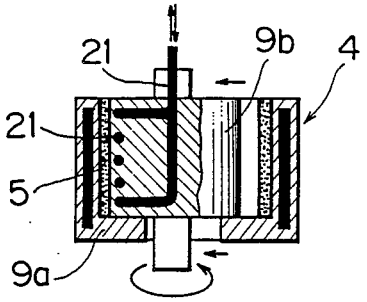
Figure 5B:
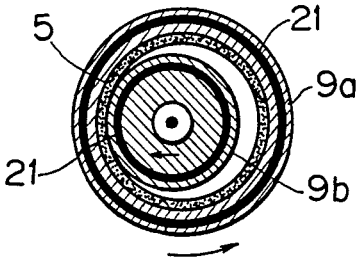

Specific molding methods include compression molding, injection molding, and ring rolling. In accordance with the present invention, mixing can be adequately accomplished outside the molding machine, so there is virtually no need to repeat the process inside the machine using a screw. Thus complex configurations can be molded with high dimensional accuracy even using the compression molding method, which is relatively free of such problems as weld lines and die stress. In addition, it is also possible to use extrusion molding, roller molding and doctor blades. FIG. 1, FIG. 2*a*, and FIG. 2*b* show an actual example of the use of die compression molding, while FIG. 3 shows an actual example of the use of injection molding. FIG. 4*a*, FIG. 4*b*, FIG. 5*a*, and FIG. 5*b* show an actual example of the use of powder ring molding.

In all these examples, the mixture (3) was introduced into the cavity (8) in lump or tablet form where it was molded by application of pressure to the mixture (3). The die was then opened, and molded object was removed.

In accordance with the present invention, the mixture contains a binder fluid of specific freezing point (2) having lower viscosity than resin binder, and the application of compressive molding pressure results in excellent flowability so that uniform density distribution is achieved to the farthest corners of the cavity.

In the case of FIG. 2*a*, when one part of the die (9*a*) is filled with the mixture (3) and the clamping block (9*c*) is lowered. The opposing part of the die (9*b*) is then moved so that it exerts a compressive action on the mixture (3). After a period of time, the clamping block (9*c*) and die (9*b*) are separated and the molded object is removed using knockout pins (15). In the case of FIG. 2*b*, molding is accomplished by forcing the stepped die (9*b*) into the opposing die (9*a*). If there is excess binder fluid, it will run away through the gaps between the clamping block (9c) and dies (9a) and (9b).

In the case of FIG. 3, the mixture (3) charged in the injection cylinder (11) is injected at a high rate into the cavity (8) by the plunger (12) via nozzle (13), while dies (9a) and (9b) are held together by a clamping device (not shown). After a period of time, dies (9a) and (9b) are opened, and the molded object is removed using the ejector pin (14). In this injection molding technique there is no need for the screw used for mixing when the conventional resin binder is used, or for any means of controlling screw temperature.

In the case of FIG. 4a and 4b, and FIG. 5a and 5b, the cavity (8) is filled with the mixture (3) while the outer die (9a) and the inner die (9b) are positioned concentrically. The outer die (9a) is then rotated relative to the inner die (9b), which is run out until, at the point at which the outer die (9b) and inner die (9a) are in the closest proximity, the mixture (3) is compression molded into a ring. After molding, inner die (9b) and outer die (9a) return to a concentric relationship and the molded object is removed.

Further, in accordance with the present invention, the mixture (3) is fast frozen to below the freezing point of the binder fluid (2) contained in it.

Cooling may be accomplished indirectly through the die walls, or by allowing a coolant to act directly on the mixture or molded object. In either case, cooling must be applied during the molding process. It is not desirable to remove the die from the molding machine and immerse it in the coolant.

In the case of indirect cooling through the die walls, cooling should be begun at or before the point at which the die is filled with the mixture (3), consideration being given to production cycle times. Cooling may also be done by stepwise reduction in the cooling temperature. It is also permissible to begin cooling after the die has been filled with the mixture, molding pressure has been applied, and molding has progressed to a certain degree, although this may lengthen the cycle time.

To cool the mixture (3) in the cavity (8) a means consisting of a duct (20) and evaporator unit (20a) is provided inside die (9a) and/or (9b) and connected to a compressor, condenser, drier, capillary tubes, expansion valve, or other freezer unit (not shown), and the desired coolant—e.g., liquid nitrogen, propane gas, liquid oxygen, or alcohol or oil that has been chilled by a cold substance such as dry ice—is passed through it. The evaporator (20a) can be removed as a unit. In the case of the molding methods shown in FIG. 4 and FIG. 5, the coolant (21) can be sprayed onto the surface of the molded mixture through the interstices of the die.

From the point of view of improving cycle time, it is recommended that the system should be cooled only to a point such that freezing does not begin until after the mixture (3) fills the die. It is also recommended that the die be wrapped in lagging, or the temperature of the area in which the molding equipment is installed by lowered.

Figure 6A:
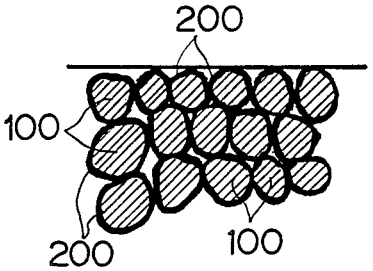
Figure 6B:
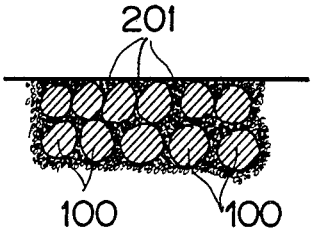

In any case, the mixture (3) is subjected to a compressive molding force by dies (9a) and (9b), which brings the powder feedstock particles (100), (100) into contact, as shown in FIG. 6a, thus also bringing into contact the extremely thin films of binder fluid (200). The films are also subjected to pressure, and the fluid squeezed out is brought to the surface region of the molded object. This is then frozen by the coolan forming fine crystals as shown in FIG. 6b. These crystals (201), (201) have a strong mutual bonding force and the feedstock powder particles (100), (100) set (harden) in the as-molded configuration, just as if bonded using a conventional resin binder.

It is not necessary that the binder fluid should freeze all the way to the center of the molded object; all that is required is that a sort of shell of a certain thickness be formed to impart sufficient strength to withstand release from the mold. The thickness of the frozen portion can be controlled by choosing a binder fluid having suitable freezing point, and by regulating the temperature and length of time of cooling.

Even when the die is cooled before being filled with the mixture, no problem is encountered since the mixture flows to the farthest corners of the die before freezing, thanks to the fact that in accordance with the present invention pressure molding is used. Molding pressure is determined by the density and dimensional accuracy required to the molded object being manufactured, but should be in the range of 200–8000 kgf/cm$^2$ for compression molding, and 200–2000 kgf/cm$^2$ for injection molding.

In techniques using a resin binder, flowability is poor at low pressures, but in accordance with the present invention good molding is achieved even at low pressure.

The above process results in a freeze-molded object (5a) being obtained. Dies (9a) and (9b) are then separated, and the freeze-molded object (5a) is removed from dies (9a) and (9b). Since the freeze-molded object (5a) has ample shape retention strength and self-support, this can easily be accomplished using knockout pins, ejector pins, etc., and handling is easy even when the walls of the freeze-molded object are thin.

When water is used as the binder fluid, adhesion to the die as a result of volumetric expansion can easily be avoided by forming a draft in the die. Specifically if an escape is arranged in the direction of die opening, the molded object (5a) will rise spontaneously when clamping pressure is released. Adhesion of the frozen portion to the die can be avoided by adding the correct amount of binder fluid, and if necessary the temperature of the die surface may be raised slightly during release by controlling the supply of coolant (21).

After it has been freezed, the freeze-molded object (5a) is dried to remove the frozen binder. This may be done either naturally or by application of heat. Another method that is particularly desirable from the point of view of preventing cracking is vacuum freeze drying. A simpler method is to place the freeze-molded object (5a) in a reduced-pressure cold room. Whichever method is used, no resin binders are used in accordance with the present invention, assuring quick and easy binder removal.

Molded objects that have been dried as described above will possess ample shape retention strength. And since there is no surface binder layer such as is produced when resin binders are used, the surface of the molded object is extremely smooth. In addition density is high, and since the viscous resistance of the binder is low, density distribution is even.

After drying, the molded object is sintered. This may be done under the conditions normally used in sintering objects molded from metallic powders, and pre-sintering and pressure sintering may be adopted if necessary. Since no resin binder is used, the sintering process is also easy to control. Even in cases where the feedstock powder is tungsten-based with water added as the binder fluid, no problem is encountered if sintering is done in a reducing atmosphere. In accordance with the present invention, high density can be obtained in the molding process, making possible reductions in sintering time.

Sintering may result in a finished product, or may be followed by any required finishing process. If required, HIP processing may also be applied.

The above processes make it possible to manufacture from metallic powders molded products that have complex configurations and high dimensional accuracy combined with uniform consistency, high density and smooth surface, making them suitable for machine components. Since the present invention eliminates the use of resin binders, there is little danger of a decrease in dimensional accuracy or strength.

Specific examples in accordance with the present invention will be listed.

EXAMPLE 1

I. A box-shaped object measuring 30 mm in length by 30 mm in width by 20 mm in height by 3 mm thickness was made using carbonyl iron powder as the feedstock and aniline as the binder fluid of specific freezing point.

II. The average diameter of the feedstock powder particles was 0.1 μm, and to it was added 25 vol % of aniline and the two substances were mixed at room temperature to a uniform consistency in a mixer.

The discs were of SKD-11 steel, with aluminum coolers embedded in both the upper and lower dies. A cooling unit using fluorine-based refrigerant was connected, and a temperature of −30° C. was obtained. The cavity was then filled with lumps of the mixture cooled to approximately 5° C. Next a molding force of 180 kgf/cm$^2$ was applied. At 53.4 tons of clamping force the upper and lower dies were cooled to −15° C. and held for approximately 5 min. The upper die was then opened, and the molded object was released by means of ejector pins.

III. The molded object set fully to the center, and there was no deformation whatever, even of the projections due to the ejector pins. The freeze-molded object was then placed is a drying furnace and dried at 200° C. for 15 min. During this drying process, the binder fluid sublimated completely, leaving no residue. The molded object was then sintered in a hydrogen atmosphere at 900° C. for 60 min.

The sintered object obtained had a density of 6.8 g/cm$^3$ uniform in all parts uniform quality despite the low molding pressure and the short sintering time. There was virtually no dimensional change, and the surface condition was exceptionally good, with an average of 3 μm roughness.

EXAMPLE 2

Figure 7:
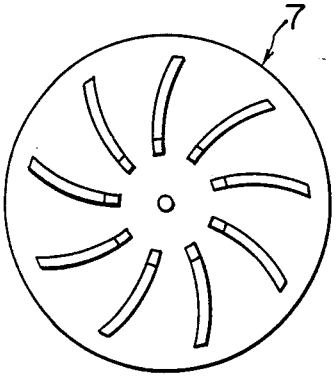
FIG. 7 is a plan view showing a prototype made using the present invention.
Figure 8:
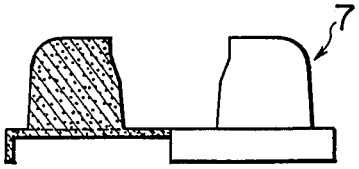
FIG. 8 shows a half cross sectional view of the same.

I. A fan-shaped object similar to that shown in FIG. 7 and FIG. 8 was made using the same powder feedstock as in Example 1. It had nine blades, and a flange outer diameter of 100 mm, blade outer diameter of 94 mm, blade height of 25 mm and blade thickness of 2 mm. Binder fluid was added in the proportion of 40 vol % of the 1 μm feedstock powder, and the two substances were mixed at room temperature to a uniform consistency in a mixer.

II. Molding was carried out in a plunger-type injection molding machine and the dies were of SKD-11 steel, with pipes embedded for cooling. Liquid nitrogen was supplied at the points where the pipes emerged from the dies.

Molding conditions were 50 tons clamping force and 400 kgf/cm$^2$ injection pressure. After injection, the die was cooled rapidly to −20° C. for 1 min and then held for approximately 3 min. The molded object was released at a die opening rate of 15 mm/sec. Molding was also carried out with the die walls cooled to −20° C. before injection, and held for 1 min after injection.

In both cases, the molded object was thoroughly frozen, and no crumbling occurred even when removed using ejector pins. This molded object was dried and sintered under the same conditions as used in Example 1.

Figure 10:
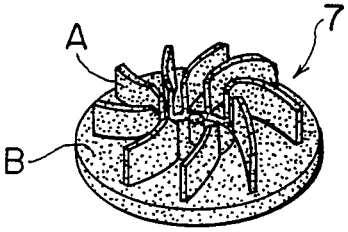
FIG. 10 is a perspective view showing an object molded in accordance with the present invention after sintering.

III. The sintered product is as shown in FIG. 10, achieving thin walls and high dimensional accuracy, despite total elimination of resin binders. Density is high, at approximately 7.0 g/cm$^2$ and its distribution was uniform in both the flange and blades, and the surface was extremely smooth.

EXAMPLE 3

I. The prototype product with the configuration shown in FIG. 7 and FIG. 8 was made using the same powder feedstock as in Example 1. The molding method used was compression molding. The molding machine was a vertical type, dies were of SKD-11, and both the upper and lower dies were wrapped with lagging. Pipes similar to those used in Example 1 were embedded in the dies, through which liquid nitrogen was passed as coolant.

II. Tap water was added to the feedstock powder in a proportion of 30 vol % and the two were mixed at room temperature in a mixer. The lower die was then filled with lumps of the mixture cooled to approximately 3° C. The lower die was precooled to −15° C., and the upper die, cooled to the same temperature, was lowered. Molding was carried out with 50 tons of clamping force and 200 kgf/cm$^2$ of injection pressure. The die was then held for approximately 3 min, the upper die was opened, and the molded object was released by applying 18 8 mm diameter pins to the flange and 9 20 mm diameter pins to the blades. The presence of a draft facilitated die release, and the freeze-molded object underwent no deformation whatsoever.

III. The freeze-molded object was dried in a vacuum cold room at −15° C. for 24 hr, and sintered at 900° C. for 1 hr in a hydrogen atmosphere. As a result density reached 7.5 g/cm$^3$ in both the flange and blades, and no cracking occurred. The surface roughness of the sintered object was extremely good both for blades and for flange and the oxidation that causes problems with sintered objects did not occur.

EXAMPLE 4

I. Tungsten powder with average particle diameter of 0.78 μm was used as the powder feedstock and water was used as the binder fluid. It was added in a proportion of 40 vol % and mixed to a uniform consistency. Molding dimensions and conditions were the same as those used in Example 1, and the injection molding method was used.

Molding conditions were 50 tons clamping force and 208 kgf/cm$^2$ injection pressure. The die was pre-cooled to −10° C. and held for approximately 4 min. The molded object was released by the same means as was used in Example 2. The ambient temperature was reduced to 5° C. during molding. The molded object was frozen to the center, die release was accomplished smoothly, and no deformation whatsoever was observed in the freeze-molded object.

II. The freeze-molded object was dried in a vacuum cold room for 20 hr, and sintered in a vacuum at 1600° C. for 1 hr. The density of the sintered object reached 18 g/cm$^3$ and surface condition was exceptionally flat. Because the product was sintered in a reducing atmosphere, there was no effect from reaction with the binder fluid.

I claim:

1. A method of obtaining high-density sintered productes from metallic powders, comprising the steps of:
   providing a metallic powder having an average particle diameter of no greater than about 1 micrometer and providing a binder fluid with a specific freezing point in a quantity of about 25–50 percent volume;
   mixing the metallic powder to be molded with the binder fluid to impart to the metallic powder a satisfactory level of flowability and sufficient shape retention strength;
   filling a desired cavity in a die with the mixture;
   rapidly cooling the mixture in the die until the binder fluid freezes so as to form a freeze-molded object with a shape and so as to impart sufficient strength to the freeze-molded object to maintain the shape of the freeze-molded object and to withstand a release from the die;
   releasing the freeze-molded object from the die;
   drying the freeze-molded object to remove the binder fluid, the freeze-molded object maintaining the molded shape without crumbling; and
   sintering the dried freeze-molded object.

2. A method for metallic powders as set forth in claim 1 wherein the binder fluid having a specific freezing point is water.

3. A method for metallic powders as set forth in claim 1 and wherein the cooling of the mixture is accomplished indirectly through the die walls by passing a coolant through passages embedded in the dies.

4. A method for metallic powders as set forth in claim 1 and wherein the cooling of the mixture is accomplished directly by the action of the coolant on the mixture in the cavity.

5. A method for metallic powders as set forth in claim 1 and wherein the cooling of the mixture is accomplished in parallel with the molding.

6. A method for metallic powders as set forth in claim 1 wherein the cooling of the mixture is begun before the cavity is filled with mixture.

7. A method as defined in claim 1, wherein the drying includes sublimating the binder fluid.

8. A method as defined in claim 1, further comprising:
   adding an organic binder having a 1 to 2 volume percentage to the binder fluid to prevent breakage during the drying and sintering.

9. A method as defined in claim 1, further comprising:
   increasing the binder fluid content by about 1–3 volume percentage; and
   extruding the freeze-molded object from the die by pressure.

10. A method as defined in claim 1, further comprising;
   molding the mixture by applying a pressure on the mixture in the die.

11. A method as defined in claim 10, wherein the molding step is effected by compression molding.

12. A method as defined in claim 10, wherein the molding step is effected by extrusion molding.

13. A method as defined in claim 10, wherein the molding step is effected by powder ring rolling.

14. A method as defined in claim 1, wherein the drying is effected by natural drying.

15. A method as defined in claim 1, wherein the drying is effected under heat.

16. A method as defined in claim 1, wherein the drying is effected by reduced-pressure freeze drying.

17. A method as defined in claim 1, wherein said freezing is stopped before the mixture freezes all the way to a center of the mixture.

18. A method as defined in claim 1, wherein the metallic powder is formed as a compound material.

19. A method as defined in claim 1, wherein the metallic powder is formed as a compound material.

20. A method as defined in claim 1, wherein the metallic powder is formed as a mixture.

21. A method as defined in claim 1, wherein the metallic powder contains nonmetallic particles and also contains metallic particles as a primary constituent.

22. A method as defined in claim 1, wherein the binder fluid is formed as an inorganic liquid other than water.

23. A method as defined in claim 1, wherein the binder fluid is formed as an organic liquid.

24. A method as defined in claim 1, wherein the binder fluid is formed as a inorganic liquid.

25. A method as defined in claim 1, wherein the binder fluid is formed as a mixture of at least two liquids other than water.

26. A method as defined in claim 1, wherein said binder fluid has a freezing point in a vicinity of 0° C.

* * * * *